United States Patent [19]

Latter

[11] 4,429,550

[45] Feb. 7, 1984

[54] SWEEP MECHANISM

[75] Inventor: Bruce B. Latter, Anchorage, Ky.

[73] Assignee: General Electric Company, Louisville, Ky.

[21] Appl. No.: 388,807

[22] Filed: Jun. 16, 1982

[51] Int. Cl.[3] ..... F25C 5/02

[52] U.S. Cl. ..... 62/353; 74/480 B

[58] Field of Search ..... 62/353; 464/157, 51; 74/480 B; 261/39 B; 251/78

[56] References Cited

U.S. PATENT DOCUMENTS

| | | | |
|---|---|---|---|
| 2,624,363 | 1/1953 | Boller | 251/78 X |
| 2,912,835 | 11/1959 | Modes et al. | 62/351 |
| 3,028,733 | 4/1962 | Mateski | 62/135 |
| 3,048,023 | 8/1962 | Taylor | 62/135 |
| 3,163,017 | 12/1964 | Baker et al. | 62/137 |
| 3,163,018 | 12/1964 | Shaw | 62/137 |
| 3,397,553 | 8/1968 | Crowe et al. | 62/353 |

*Primary Examiner*—William E. Tapolcai
*Attorney, Agent, or Firm*—Frederick P. Weidner; Radford M. Reams

[57] ABSTRACT

An icemaker comprising a freezer mold having an ice piece forming cavity, ice ejecting means including means to release the ice piece from the cavity and a pad mechanism for raising the ice piece from said cavity to a position above the top of the cavity, a sweep pivotally supported above the mold for movement from a first position rearward of the cavity to a second position overlying the cavity for engaging and sweeping the raised ice piece from the mold. There is included drive means for rotating a drive element in one direction and then in the opposite direction. A torsion spring is arranged to store energy during movement of the sweep from its first position to its second position. There are means coupling the drive element to the sweep to drivingly engage the sweep and move the sweep from the first position to the second position and for coupling the torsion spring to the sweep to return the sweep from the second position to the first position upon release of the stored energy. With this arrangement the sweep has positive movement in the direction needed to harvest the ice cubes from the mold but on its return movement if any obstruction is encountered, the obstruction can be readily removed and also jamming of the mechanism is prevented.

5 Claims, 5 Drawing Figures

FIG. 3
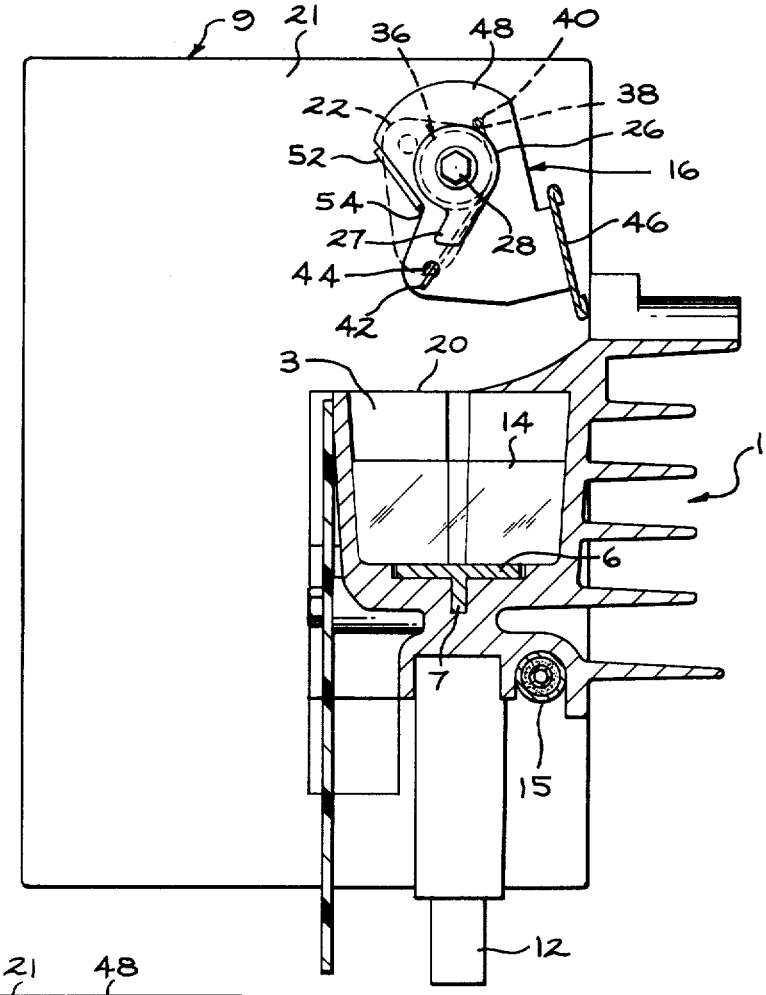
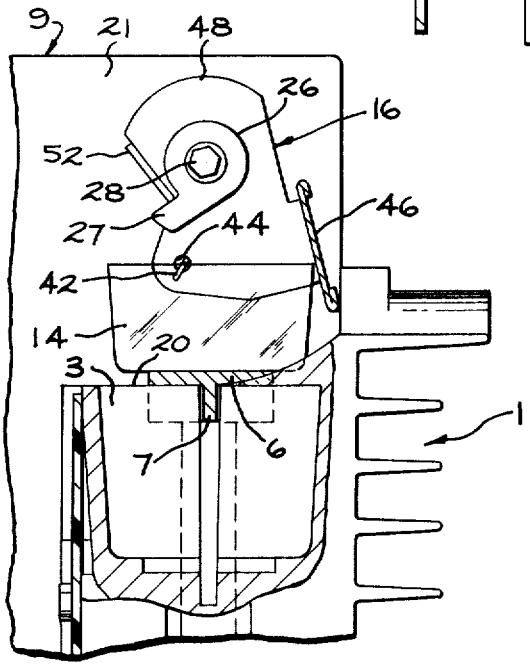
FIG. 4

SWEEP MECHANISM

BACKGROUND OF THE INVENTION

The present invention relates to an automatic icemaker for use in household refrigerators, the icemaker being of the type shown and described in U.S. Pat. Nos. 3,163,017—Baker and U.S. Pat. No. 3,163,018—Shaw, issued Dec. 29, 1964. The icemaker comprises a mold including at least one ice cavity in which water is frozen to form an ice piece, ejecting means usually including a heater to slightly melt the ice piece and release it from the cavity, a pad normally positioned in the lower portion of the cavity and movable to a position above the top of the cavity for ejecting an ice piece from the cavity once the ice piece is released from the cavity and a pivoted sweep or rake actuable after the ice piece has been raised to its upper position for movement across the top of the mold cavity to remove the ice piece from the pad. The sweep means disclosed in the aforementioned patents rotates about a pivot axis above the cavity from a rearward or first position to one side of the cavity through an arcuate path outward to a second position above the cavity. The sweep is so designed that the ice engaging portion thereof clears the pad in its upper position.

Under some operating conditions of this type of icemaker, it has been found that on occasion when the sweep is to be returned from its outward position after sweeping the ice cubes from the mold there is encountered an object, such as a broken ice piece, etc., that obstructs its return to its rearward position. Heretofore the sweep has been mechanically moved or pivoted in both directions of rotation by a positive mechanical gear mechanism. With such an arrangement when the sweep's rearward movement is obstructed it is difficult to remove any object that is caught between the sweep and the mold which obstruction can cause the mechanism to be jammed and possibly damage the icemaker mechanism.

By this invention there is an arrangement that provides positive driven outward movement of the sweep necessary to remove the elevated ice pieces from the mold and during the rearward movement of the sweep back to its first position any object that may be blocking its path may be readily withdrawn and also jamming of the mechanism is prevented.

SUMMARY OF THE INVENTION

In accordance with one aspect of the present invention, there is provided an icemaker comprising a freezer mold having an ice piece forming cavity, ice ejecting means including means to release the ice piece from the cavity and a pad mechanism for raising an ice piece from said cavity to a position above the top of said cavity, a sweep pivotally supported above the mold for movement from a first position rearward of the cavity to a second position overlying the cavity for engaging and sweeping the raised ice piece from the mold. There is provided drive means for rotating a drive element in one direction and then in the opposite direction. A torsion spring is arranged to store energy during movement of the sweep from its first position to its second position. There are means coupling the drive element to the sweep to drivingly engage the sweep and move the sweep from the first position to the second position and for coupling the torsion spring to the sweep to return the sweep from the second position to the first position upon release of the stored energy. With this arrangement, in the event the return of the sweep from the second position to its first position encounters an obstruction the mechanism continues to operate and return to its intended position and stop its operation while the sweep is retained by the object, however, the object may be readily removed after which the torsion spring returns the sweep to its first position and damage to the mechanism has been prevented.

BRIEF DESCRIPTION OF THE DRAWINGS

FIG. 3 is a partial cross-sectional view taken along lines 3—3 of FIG. 1 and showing the component arrangement of the icemaker preparatory to the ice piece ejection operation.

FIG. 4 is similar to FIG. 3 showing the component arrangement of the icemaker at one stage of the ice piece ejection operation.

DESCRIPTION OF THE PREFERRED EMBODIMENT

Figure 1:
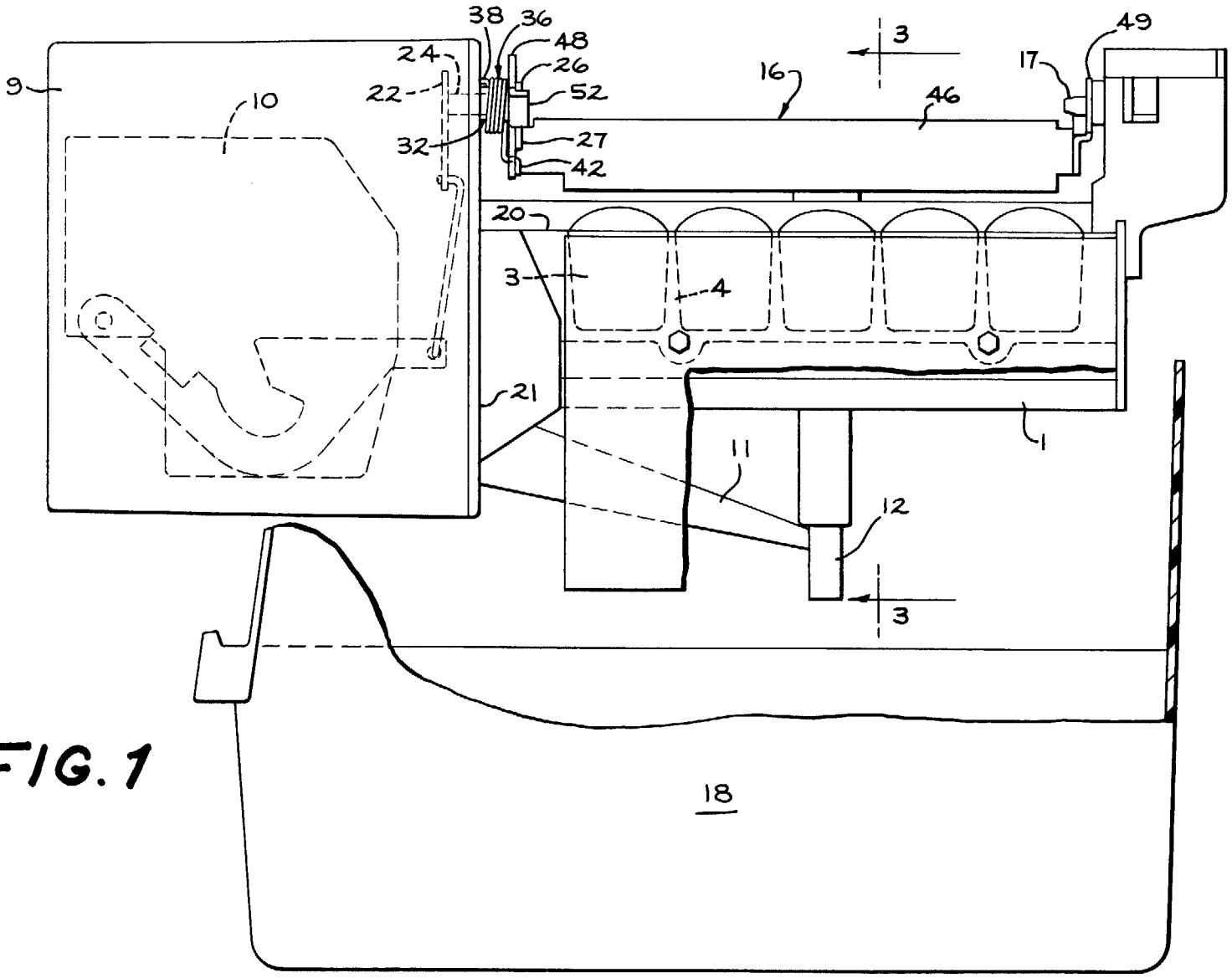
FIG. 1 is an elevational view of an icemaker embodying one form of the present invention.

The automatic icemaker illustrated in the accompanying drawings comprises a mold 1 adapted to be secured in any suitable manner to a wall of the freezer compartment of a household refrigerator. The mold includes a plurality of generally cylindrical ice cavities 3 arranged in a straight line and separated from one another by walls 4, each of which includes a vertical passage 5 (FIG. 2) which provides means for the flow of water from one cavity to another during the mold filling operation. A plurality of pads or pistons 6 (FIGS. 3 and 4) which to a substantial extent form the bottoms of the cavities 3 are interconnected by a bar 7 (FIGS. 3 and 4) slidably received within the passages 5.

Power and control means for operating the icemaker is generally contained within a housing 9 secured to one end of the mold, this mechanism including a motor 10 connected through drive means including a lever 11 and a rod 12 is designed to raise the pads 6 and the ice pieces, such as the ice piece 14 (FIG. 4), carried thereby out of the cavities 3.

The icemaker also includes an elongate rake or sweep 16 extending substantially the full length of the mold 1. The sweep is normally positioned at one side of the cavities as illustrated in FIG. 3 of the drawing.

The sweep is pivotally supported on the mold structure above the upper surface 20 of the mold 1 or more specifically above the cavities 3 so that during rotational movement thereof about its pivot axis, it will move from a position to one side of the mold cavity which is its first position into engagement with the ice pieces supported on the pads 6 and then part way across the space above the cavities which is the second position for the purpose of sweeping the ice pieces off of the pads and into the storage basket 18 positioned below the mold.

For a more detailed description of the construction and operation of the icemaker thus far described reference is made to the aforementioned patents to Baker and Shaw. As is more fully described therein, the automatic operating cycle of the icemaker comprises filling of the cavities 3 with water, freezing the water to make ice pieces, means to free the formed ice pieces from the cavities such as by a mold release agent or as shown in the preferred embodiment heating the mold by a heater 15 (FIG. 3), ejection of the ice pieces by movement of the pads 6 from their lower position in the bottom of the cavities to a raised position slightly above the upper surface 20 of the mold, pivotal movement of the sweep 16 from its rearward position across the top of the mold for engaging the ejected ice pieces 14 and sweeping the ice pieces from the mold and return of the sweep to its rearward position and the pad 6 to its lower position followed by the introduction of another charge of water into the mold cavities to repeat the cycle.

In the sweeping movement of the sweep 16 to harvest the ice pieces, it is necessary to apply sufficient positive force to the ice pieces 14 to break any of the pieces still frozen to the pad 6 loose for discharge into the receptacle 18. To assure this positive release of the ice pieces from the ejector pad, the sweep must be sufficiently rigid to break the ice pieces loose. In addition, the sweep must be positively driven in its outward arcuate movement from its first position to its second position so that upon engagement with the ice pieces it will break the ice pieces from the pads 6 by exerting considerable force thereon. This outward movement of the sweep is accomplished by a motor driven gear mechanism shown and described in the aforementioned patents to Shaw and Baker.

In the return of the sweep from its second position overlying the mold cavity to its first position rearward of the mold cavity, there has been heretofore a positive mechanical drive similar to the drive arrangement for moving the sweep from the first position to its second position. Difficulty can be encountered at times when in the return movement of the sweep from its second to its first position the sweep encounters an obstacle such as a frozen package, a broken ice piece, etc., that prevents its return to the first position. Because of the positive rearward driving motion of the sweep in the prior art icemaker mechanism, the obstacle is firmly clamped between the sweep and the mold as the motor continues to run and the mechanism continues its effort to return the rigid sweep to its rearward most position. In such circumstances it is possible to damage the mechanism, however, with the below-described arrangement there is provided a means to eliminate that possibility.

Figure 2:
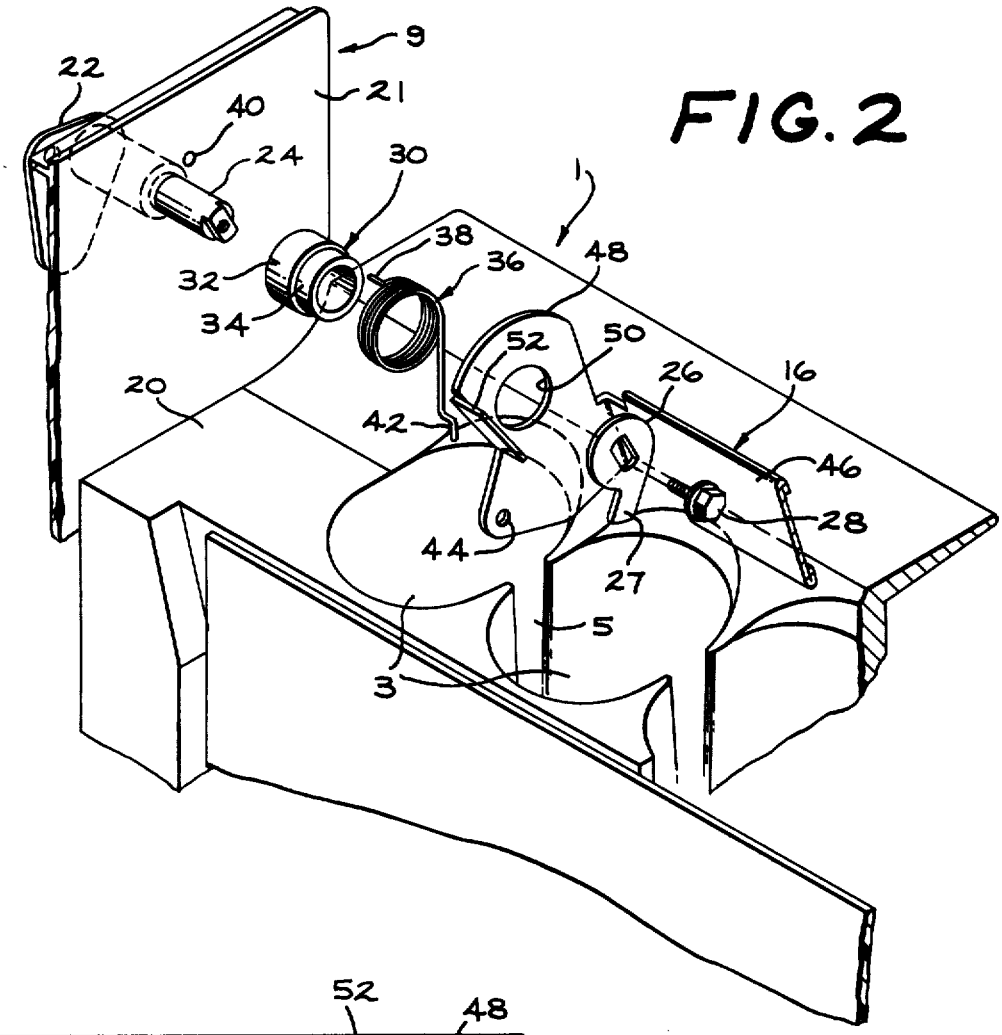
FIG. 2 is an exploded perspective view showing the component arrangement of the present invention.

With reference particularly to FIG. 2 the icemaker mechanism of the present invention is shown in an exploded assembly perspective view and includes the mold 1 with the ice cavities 3 side by side and separated by a vertical passage 5. At one end of the mold 1 there is the housing 9 having a front wall 21. On the side of the front wall 21 opposite from the mold 1 there is a drive link 22 which by a motor and mechanical arrangement is driven to rotate about an axis. Connected to and rotated in unison with the drive link 22 is a drive element 24 such as a rotatable axle to which is keyed a drive dog 26 having a tooth portion 27. The drive dog 26 is retained in its position on the drive element 24 by a screw 28 such that upon rotation of drive link 22 the drive element 24 rotates in unison therewith and so does the drive dog 26. Surrounding the drive element 24 is a collar 30 which has a rearward section 32 slightly larger in diameter than a forward section 34. The rearward section 32 has surrounding it a torsion spring 36 which has one end 38 stationarily inserted into an aperture 40 in the front wall 21 of the housing 9. The other end 42 of the torsion spring 36 is inserted in an aperture 44 formed in the sweep 16. It will be noted that the sweep 16 includes an elongated blade portion 46 and a pivot mounting portion 48 and 49 at each end thereof which are at a right angle to the blade portion 46. The pivot mounting portion 48 includes an aperture 50 through which is received the forward section 34 of the collar 30. The pivot mounting portion 48 also includes a depending tang 52, the purpose of which will be described below. The other pivot mounting portion 49 is mounted to pivot stud 17.

With the above-described arrangement the sweep 16 is mounted for pivotal movement about the collar 30 and pivot 17 and when the sweep moves from its rearward first position to its outward second position, the torsion spring 36 stores energy due to the spring being wound up. As viewed in FIG. 2 this movement would be in a clockwise direction relative to the drive element 24. When the sweep 16 is to be moved or pivoted from its second position to its first position, the energy stored in the torsion spring 36 will be released by the spring unwinding and the sweep 16 will be caused to pivot back to its first position.

Figure 5:
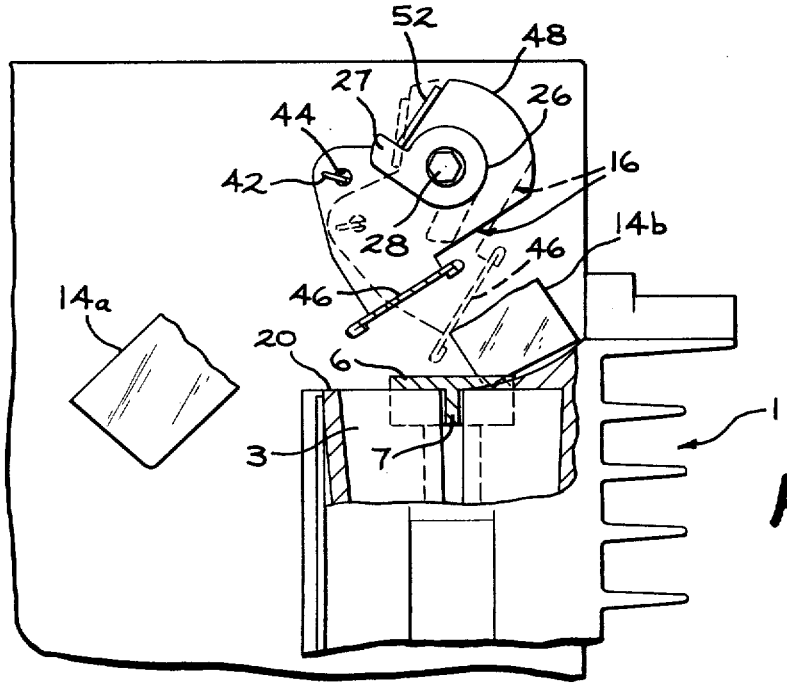
FIG. 5 is similar to FIGS. 3 and 4 showing the component arrangement of the icemaker during rearward movement of the sweep and encountering an object which prevents movement of the sweep to its rearward or first position.

With reference to FIGS. 3–5 in particular, the operation of the icemaker mechanism will now be described. FIG. 3 shows the icemaker mechanism for ejecting the ice with the components of the mechanism in the "at rest" position ready to harvest the ice piece 14 which has been formed by freezing water in the cavity 3 of mold 1. The mold 1 is normally cast from aluminum for good heat transfer characteristics. Located at the bottom of the mold 1 is an electric resistance heater 15 which when energized generates sufficient heat to the metal mold 1 to slightly melt the ice pieces around their periphery and free them from the sidewalls of the mold cavity. Above the mold cavity 3 is the sweep 16 with its elongated blade portion 46 in the rearward or first position where it is out of the way of the ice piece being raised from the cavity 3. In this position the torsion spring 36 has a minimal tension and the drive dog 26 having a tooth portion 27 is out of contact with depending tang 52 formed as a part of the sweep 16 as discussed above. By a suitable timing mechanism, electric motor and mechanical drive means as is well known in the prior art, the ice piece ejection operation begins with the heater 15 being energized to slightly melt the ice pieces and release them from the mold cavity 3. At the completion of that operation the icemaker mechanism assumes the position shown in FIG. 4 wherein the pads 6 have been moved upwardly through the cavity 3 to forcibly move the ice piece 14 to above the upper surface 20 of the mold 1 where the ice piece 14 will sit upon the pad 6. The icemaker ejection mechanism through drive link 22 and drive element 24 have rotatively driven the drive dog 26 to the position shown in FIG. 4 wherein the tooth portion 27 has engaged the lower lip or edge 54 of the tang 52. It will be noted that at this time in the sequence of the ice piece removal operation that the elongated blade portion 46 is still in its rearward or first position. With continued rotational movement of the drive element 24 the drive dog 26 by its rotational movement has caused the sweep 16 to be rotated about its pivot axis to its second position as shown in full line in FIG. 5. During the movement of the sweep 16 from its first position shown in FIG. 4 to the second position shown in full line in FIG. 5 the torsion spring 36 has stored energy by its being wound up during the movement of the sweep to which one end of the torsion spring is attached. In FIG. 5 there is illustrated a broken ice piece wherein a part of the ice piece 14*a* has been ejected out the front of the mold to fall into the receptacle 18 and a portion 14*b* of the ice piece has remained in the rear of the mold resting on top of the pad 6. When the rotational movement of the sweep 16 from its first position to its second position is complete, the icemaker mechanism no longer drives the sweep in a clockwise motion. By linkage means while the icemaker mechanism continues to be driven by the motor, the drive dog 26 is caused to rotate counterclockwise whereupon the torsion spring will release its stored energy and move the sweep 16 from its second position to its first rearward position. However, as shown in FIG. 5 in phantom line when the sweep 16 encounters the object such as the broken ice piece 14*b*, it will be stopped while the icemaker mechanism will continue to rotate the drive dog 26 to the position shown in FIG. 3 which is its "at rest" rearward position. The torsion spring 36 has a very light spring force so that upon the sweep 16 encountering the broken ice piece 14*b* it merely stays there until the broken ice piece is removed. Its removal is quite easy since the sweep may be pivoted back and forth to remove the obstacle by merely overcoming the light spring force of the torsion spring. Once the broken ice piece or other obstacle is removed the tension spring 36 releases more stored energy and rotates the sweep to its rearward first position (FIG. 3).

With the above described operation it will be understood that the torsion spring 36 is arranged to store energy during movement of the sweep from its first position to its second position and only minimum energy is to be stored sufficient to pivot the sweep from its second position back to its first position. It will also be understood that with one end 38 of the torsion spring 36 being stationary by having it mounted in the aperture 40 of the housing wall 21 and the other end 42 connected to the rotating sweep by aperture 44 that the movement of the sweep from the first position to the second position is when the torsion spring 36 stores the energy to be released subsequently to return the sweep to its first position. By this arrangement then the forward motion of the sweep from its first position to its second position is by a direct mechanical drive sufficient to break the cubes loose from the pad 6 and push then into the underlying receptacle 18 whereas in the return movement of the sweep 16 only light force is necessary so that if an obstacle is encountered when the sweep is being moved from the second position to the first position it will allow the mechanism to continue to operate without jamming and permit removal of the obstacle easily and damage to the icemaker mechanism has been prevented.

While, in accordance with the patent statutes, there has been described what at present is considered to be the preferred embodiment of the invention it will be obvious to those skilled in the art that various changes and modifications may be made thereto without departing from the invention. It is therefore intended by the appended claims to cover all such changes and modifications as fall within the true spirit and scope of the invention.

What is claimed is:

1. An icemaker comprising a freezer mold having an ice piece forming cavity, ice ejecting means including means to release the ice piece from the cavity and a pad mechanism for raising the ice piece from said cavity to a position above the top of said cavity, a sweep pivotally supported above said mold for movement from a first position rearward to said cavity to a second position overlying said cavity for engaging and sweeping the raised ice piece from said mold;

motor driven positive mechanical drive means for rotating a drive element in one direction and then in the opposite direction;

a torsion spring arranged to store energy during movement of the sweep from its first position to its second position;

means mechanically coupling the drive element in one direction of rotation to the sweep to positively drive the sweep and move the sweep from the first position to the second position;

and means coupling the torsion spring to the sweep to return the sweep to its first position upon relase of the stored energy when the drive element is rotated by the motor driven positive mechanical drive means in its opposite direction.

2. The icemaker of claim 1 wherein the torsion spring is arranged to only store minimum energy sufficient to pivot the sweep from its second position back to its first position.

3. The icemaker of claim 1 wherein the torsion spring is a coil spring having one end stationary and the other end attached to and movable with the sweep.

4. The icemaker of claim 3 wherein the drive element is a rotatable axle and passes through the coil spring.

5. The icemaker of claim 1 wherein the means coupling the drive element to the sweep is a drive dog having a tooth portion, said drive dog being secured to and rotated in unison with the drive element and engages a tang formed on the sweep to move the sweep from the first position to the second position.

* * * * *